United States Patent [19]

Uetani

[11] Patent Number: 4,802,082

[45] Date of Patent: Jan. 31, 1989

[54] SUPERVISORY SYSTEM FOR ELEVATORS

[75] Inventor: Kenichi Uetani, Aichi, Japan

[73] Assignee: Mitsubishi Denki Kabushiki Kaisha, Japan

[21] Appl. No.: 53,539

[22] Filed: May 26, 1987

Related U.S. Application Data

[63] Continuation of Ser. No. 619,913, Jun. 12, 1984, abandoned.

[30] Foreign Application Priority Data

Jun. 17, 1983 [JP] Japan ..... 58-108968

[51] Int. Cl.[4] ..... B66B 1/18

[52] U.S. Cl. ..... 364/138; 364/151; 364/192; 187/127

[58] Field of Search ..... 187/29 R, 124, 125, 187/126, 127, 128, 131; 340/19 R, 19 A; 364/138, 146, 150, 151, 191–193

[56] References Cited

U.S. PATENT DOCUMENTS

| | | | |
|---|---|---|---|
| 3,593,825 | 7/1971 | Gieseler | 187/29 R |
| 3,804,209 | 4/1974 | Edison | 187/29 R |
| 4,293,915 | 10/1981 | Carpenter et al. | 364/146 |
| 4,330,838 | 5/1982 | Yoneda et al. | 364/426 |
| 4,370,717 | 1/1983 | Hummest et al. | 364/436 |
| 4,379,335 | 4/1983 | Kirsch et al. | 364/192 |
| 4,401,192 | 8/1983 | Trosky et al. | 364/551 |
| 4,411,338 | 10/1983 | Kuzunuki et al. | 187/29 R |
| 4,448,286 | 5/1984 | Kuzunuki et al. | 187/127 |
| 4,473,134 | 9/1984 | Uetani | 187/29 R |
| 4,506,127 | 4/1985 | Yuki et al. | 364/192 |
| 4,536,842 | 8/1985 | Yoneda et al. | 187/127 |
| 4,542,463 | 3/1985 | Uetani | 187/127 |
| 4,567,558 | 1/1986 | Umeda et al. | 364/148 |
| 4,567,566 | 1/1986 | Araya et al. | 187/29 R |

FOREIGN PATENT DOCUMENTS

| | | |
|---|---|---|
| 55-115566 | 9/1980 | Japan . |
| 57-62279 | 4/1982 | Japan . |
| 58-69680 | 4/1983 | Japan . |
| 2129971 | 5/1984 | United Kingdom . |

*Primary Examiner*—John R. Lastova

*Attorney, Agent, or Firm*—Leydig, Voit & Mayer

[57] ABSTRACT

In a supervisory system for elevators, a learning function for changing and controlling the operations of the elevators so as to be suited to the traffic conditions of a building is provided. The traffic conditions are automatically learned by taking the statistics therefor to revise the learing function program by externally applying revisional information, where alterations of the learning function program conforming to traffic conditions in the building are made possible to render the learning function flexible.

11 Claims, 12 Drawing Sheets

FIG. 3

| | 1 | 2 | 3 |
|---|---|---|---|
| TK1 | 0810 | 0855 | COM-PLETED |
| TK2 | | | |
| TK3 | | | |
| TK4 | | | |

FIG. 4

| | 1 | 2 | 3 |
|---|---|---|---|
| TB1 | -020 | +010 | -3 |
| TB2 | | | |
| TB3 | | | |
| TB4 | | | |

FIG. 5

| | |
|---|---|
| NAME 1 | OFFICE-GOING ΔHOUR ΔOPERATION |
| NAME 2 | LUNCH ΔTIME ΔFIRST-HALF ΔOPERATION |
| NAME 3 | LUNCH ΔTIME ΔLATER-HALF ΔOPERATION |
| NAME 4 | CLOSING ΔHOUR ΔOPERATION |

FIG. 8

```
Y 01234----
0
1 PATTERNΔSCHEDULEΔANDΔREVISION
2 OFFICE-GOING HOUR OPERATION
3 RESULTΔΔ = SELECTION (08,10); TERMINATION (08,55);(COMPLETION)
4 REVISION = ΔSELECTION (-0.20); TERMINATION (+0,10); INTENSITY (-3)
5
6
7 IS THERE ANY REVISION?
8
9
------
```

SUPERVISORY SYSTEM FOR ELEVATORS

This application is a continuation of application Ser. No. 619,913, filed June 12, 1984 and now abandoned.

BACKGROUND OF THE INVENTION

The present invention relates to a supervisory system for elevators which has a learning function of predicting the traffic in elevators from the present time.

In general, in a building or the like in which a plurality of elevators are installed, it is desirable to supervise the operation of the elevators properly in conformity with the traffic situation in the building.

Therefore, supervisory systems for elevators having a learning function for supervising the operation of the elevators have hitherto been proposed as described in, for example, the published Japanese Laid-open Patent Applications Nos. 55-115566 and 57-62179.

The supervisory systems for elevators with learning function consider the statistics of the traffic conditions of the elevators over a period from the past to the present, and predict the traffic conditions (including services) from the present, such as the selection of traffic patterns and the getting-on and -off of passengers at respective floors, on the basis of the statistic results, to supervise the operation of the elevators.

Thus, the elevators traffic can be precisely predicted in advance, and the service of the elevators can be automatically altered so as to suite changes in traffic in the building as they occur, so that the service is enhanced every day and every moment without any manual operation.

In such a supervisory system for elevators, however, the method for enhancing the service by the learning function is fixed, including previously determined control variables to which importance is attached, i.e., the waiting periods of time, prediction rate of servicing guide lamps, the service for a specified floor during an operation pattern, or the service for general floors during the operation pattern. Furthermore, the results decided by the learning function are directly used as the control signals of the elevators.

It is therefore impossible to alter the method for enhancing the service by the learning function or the control variables of the learning function to which importance is attached. This has led to the drawback that the operation service of elevators most suited to the building cannot always be attained.

SUMMARY OF THE INVENTION

The present invention has for its object to eliminate the problem described above and to provide a supervisory system for elevators which can alter a learning function in compliance with the requirement of a building.

In one aspect of performance of the present invention, a supervisory system for elevators which has a learning function of predicting traffic conditions from the present time on the basis of statistical results obtained by utilizing observed traffic conditions of the elevators over a period from the past to the present comprises revisional information input means to supply revisional information for internal elements of the learning function program, and learning function revision means to revise internal elements of the learning function program in accordance with the revisional information applied by said revisional information input means and by internal elements is meant to include control variables included in the program as well as the steps of the program.

BRIEF DESCRIPTION OF THE DRAWINGS

FIGS. 3, 4 and 5 are diagrams showing examples of a learning result table, a revisional value table and an operation pattern appellation table which are stored in a personal computer in FIG. 2, respectively;

FIG. 8 is a diagram showing an example which is displayed by a display device in FIG. 2 when the subprogram in FIG. 7 has been run;

DESCRIPTION OF THE PREFERRED EMBODIMENT

Figure 1:
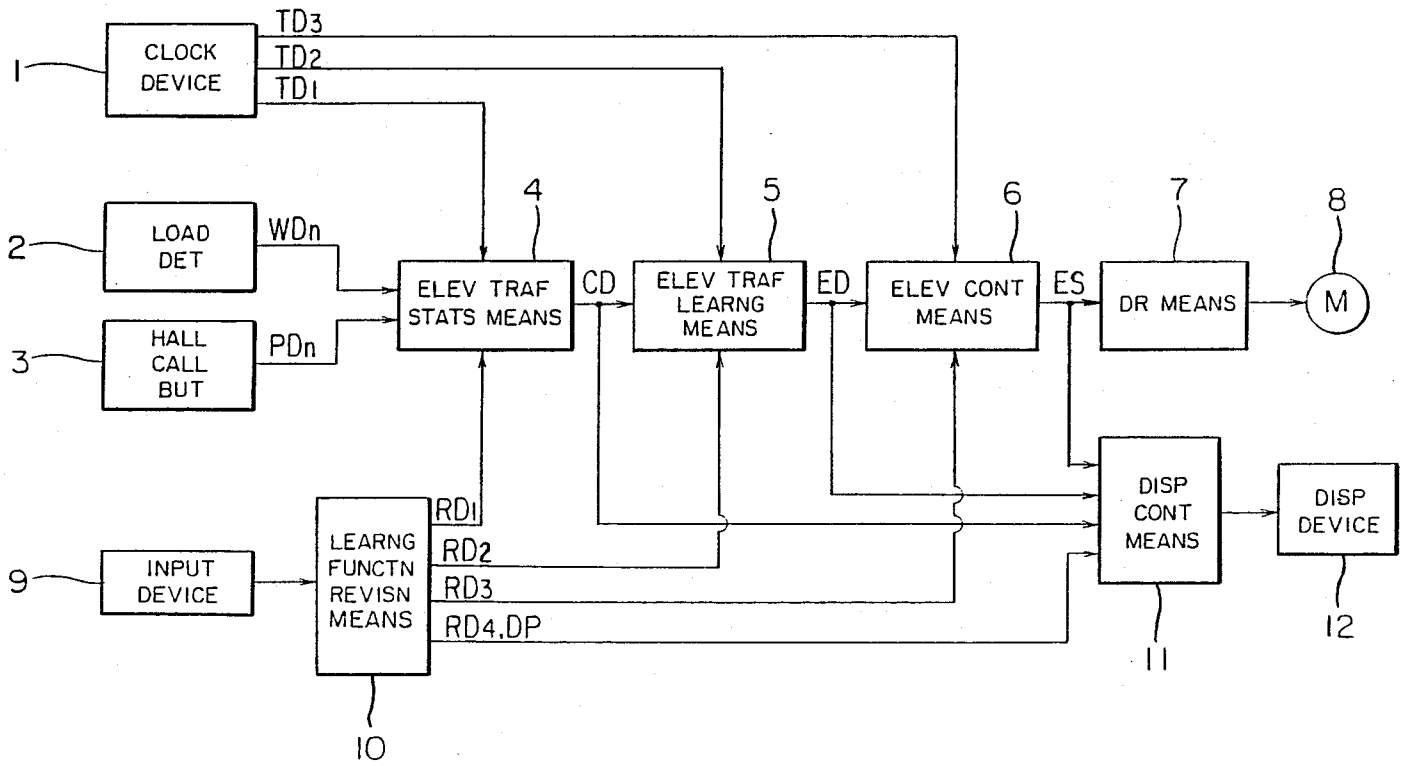
FIG. 1 is a block arrangement diagram showing the fundamental embodiment of the present invention.

FIG. 1 is a block arrangement diagram showing a preferred embodiment of the present invention.

Referring to the figure, a clock device 1 has months and days for each year set therein beforehand. It measures the present hour, day, day of the week, and month by, for example, updating the day in 24-hour increments and updating the day of the week in single-day units and in 7-day cycle, and delivers the measured results as time data $TD_1$–$TD_3$, respectively.

Load detectors 2 deliver load detection signals $WD_n$ ($n=1, \ldots, N$) which correspond to the numbers of passengers in N cages.

Hall call buttons 3 are disposed in the respective halls of M floors, and they provide hall call signals $PD_m$ ($m=1, \ldots, M$) when depressed.

Elevator traffic statistic means 4 receives the time data $TD_1$ from the clock device 1, the load detection signals $WD_n$ from the load detectors 2, the hall call signals $PD_m$ from the hall call buttons 3 along with other elevator traffic information which will be explained later. It takes the statistics of the traffic conditions of elevators, and delivers statistic data CD.

By way of example, this elevator traffic statistics means 4 calculates the numbers of getting-on passengers and the numbers of getting-off passengers at the respective floors and in the respective directions on the basis of the load detection signals $WD_n$ from the load detectors 2 and the statistics of the numbers of getting-on passengers and the numbers of getting-off passengers at the respective floors in respective predetermined time zones on the basis of the time data $TD_1$ from the clock device 1.

In addition, it takes the statistics of times for selecting patterns at any specified floor on the basis of the load detection signals $WD_n$ from the load detectors 2 and the time data $TD_1$ from the clock device 1.

Further, it registers the hall call signals $PD_m$ and takes the statistics of average waiting times and long waiting calls at the respective floors on the basis of the hall call signals $PD_m$ from the hall call buttons 3 and the time data $TD_1$ from the clock device 1.

Although this elevator traffic statistics means 4 takes other various statistics, the details are described in the aforecited official gazettes and shall be omitted from the description.

Elevator traffic learning means 5 receives the time data $TD_2$ from the clock device 1 and the statistic value data CD of the various traffic conditions from the elevator traffic statistics means 4, and predicts (learns) future traffic conditions on the basis of the statistic values obtained from past times up to the present time, and provides the predicted (learned) data ED of the elevators in accordance with the predicted results.

By way of example, this elevator traffic learning means 5 performs the complicated processing of delivering the average values of the statistic values for the past M days as the prediction data; keeping past prediction data items stored in an internal storage device and comparing them with new statistic values, to create new prediction data; or predicting the future traffic which takes the present traffic into account to some extent. Since the details are known from the aforecited official gazettes etc., they shall be omitted from the description.

On the basis of the time data $TD_3$ from the clock device 1, the prediction data ED from the elevator traffic learning means 5, and the present traffic conditions, elevator control means 6 supplies a driving device 7 with a control signal ES for controlling the respective portions of each elevator. Thus, it controls the respective portions of the elevator in such a manner that a hoist motor 8 for driving a cage is controlled to run the cage to a destination floor and that a motor for opening and closing a door, not shown, is controlled to open or close the door.

This elevator control means 6 controls the respective portions on the basis of predetermined data when the reliability of the predicted results of the elevator traffic learning means 5 is low.

An input device 9 serves also as revision information input means, and provides revision information for revising a learning function, a display instruction, etc., in accordance with the operations of an operator.

Learning function revision means 10 records the revision information from the input device 9 and revises the learning function so as to deliver the revised results to the elevator traffic statistics means 4, the elevator traffic learning means 5, the elevator control means 6 and display control means 11 as revision data $RD_1$–$RD_4$, respectively. Also, it delivers the display instruction from the input device 9 to the display control means 11 as display command data DP.

On the basis of the command from the input device 9 received by the learning function revision means 10 as the display command data DP, the display control means 11 receives the statistic data CD from the elevator traffic statistics means 4, the learning data ED from the elevator traffic learning means 5, the control signal ES from the elevator control means 6, and the revision data $RD_4$ from the learning function revision means 10 and causes a display device 12 to display various necessary information.

Since, in this manner, internal elements of the learning function program can be revised by externally applying revision information, the operation supervision of elevators most suited to the traffic situation of each building or the like can be realized, and the service is enhanced.

Figure 2:
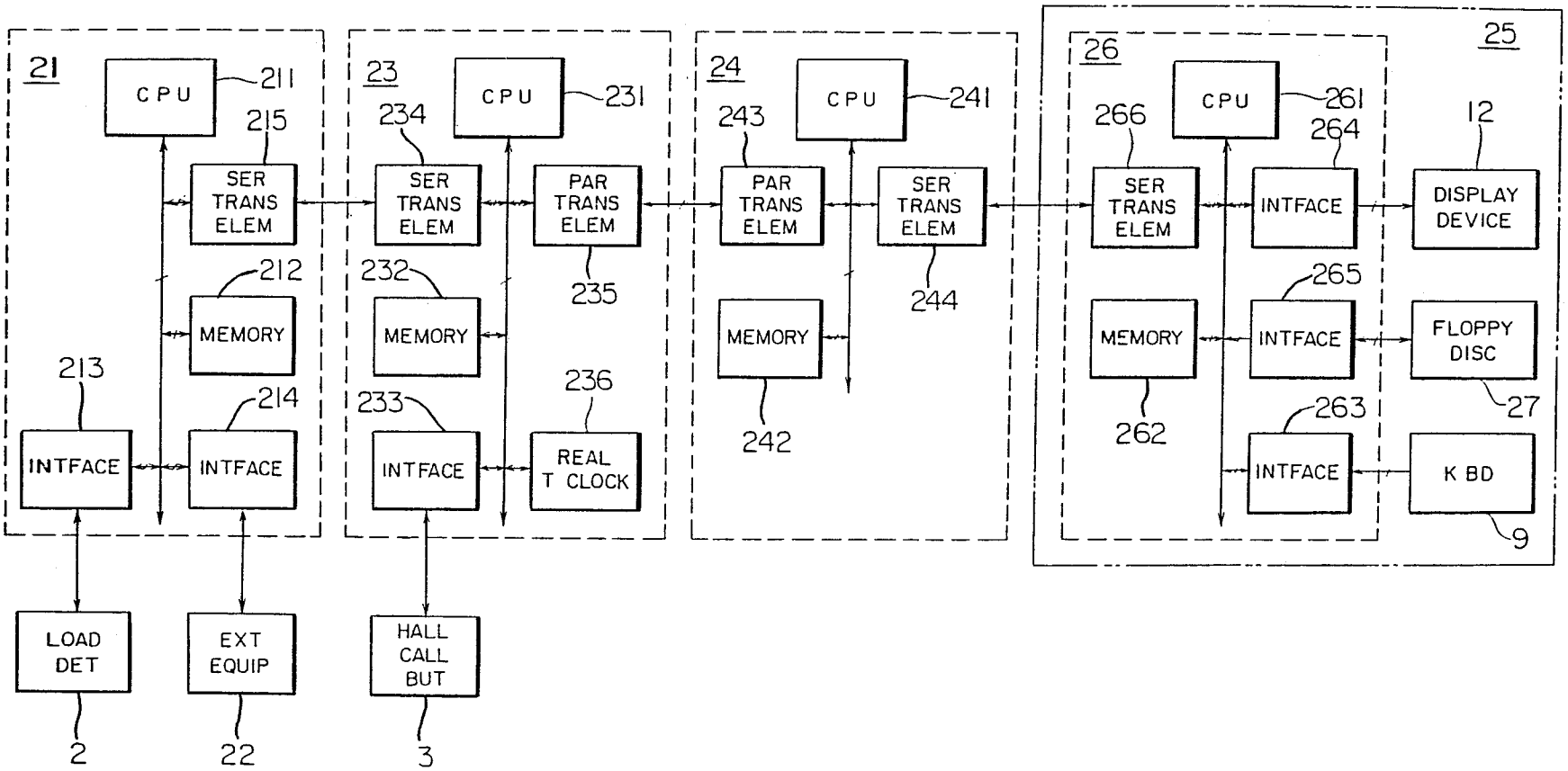
FIG. 2 is a block diagram showing an example of a supervisory system for elevators in which the present invention is performed.

FIG. 2 is a block diagram showing an example of the supervisory system for elevators in which the present invention is performed. The same parts as in FIG. 1 are assigned identical symbols, and shall not be explained.

Referring to the figure, a cage control device 21 is constructed of a CPU (central processing unit) 211; a memory 212 which includes a ROM and a RAM for storing programs and data; interfaces 213 and 214 each of which includes a level conversion element, a buffer element, an electromagnetic relay, etc. and converts the level of external transmission data; and a serial transfer element serial/parallel communication interface) 215 which transmits data serially. The cage control device 21 receives the load detection signal from the load detector 2, and delivers the control signal to an external equipment 22 such as the cage running motor or the door opening and closing motor.

Although such cage control devices 21 are disposed in the number n as determined by the number of cages, only one device is illustrated here.

A group supervisory device 23 is constructed of a CPU 231, a memory 232, an interface 233, a serial transfer element 234, a parallel transfer element (parallel interface) 235 which transmits data in parallel, and a real time clock 236 which measures the present time (composed of second, minute, day, month and year). The group supervisory device 23 receives the hall call signals from the hall call buttons 3.

The cage control devices 21 and the group supervisory device 23 constitute the elevator control means 6 in FIG. 1.

A statistics device 24 is constructed of a CPU 241, a memory 242, a parallel transfer element 243, and a serial transfer element 244. This statistics device 24 constitutes the elevator traffic statistics means 4 in FIG. 1 and a part of the elevator traffic learning means 5 as well as the learning function revision means 10.

A personal computer 25 is installed on an operator's panel or the like, and it is constructed of the keyboard (input device) 9, the display device 12, a microcomputer 26, and a floppy disc device 27 for storing programs and data.

The microcomputer 26 is composed of a CPU 261, a memory 262, interfaces 263, 264 and 265, and a serial transfer element 266. It loads a necessary program from the floppy disc device 27 into the memory 262, and executes the program.

This microcomputer 26 constitutes the learning function revision means 10 in FIG. 1.

By way of example only, "8086" manufactured by Intel Inc. can be used as the CPU in any of these portions, "8251" manufactured by the same can be used as the serial transfer element, "8255" manufactured by the same can be used as the parallel transfer element, and "MULTI 16"manufactured by Mitsubishi Electric Co., Ltd. can be used as the personal computer 25.

Next, the operation of this embodiment thus constructed will be described by referring also to FIG. 3 et seq.

Referring first to FIGS. 3 to 5, tables to be stored in the memory 262 of the personal computer 25 or the floppy disc device 27 will be described.

FIG. 3 is a diagram showing an example of the table of elevator control signals (prediction data) which are learned results received from the statistics device 24 (hereinbelow, termed "learning result table").

The data of scheduled times for initiating the selection of the respective operation patterns of an office-going hour operation (an operation for the period of time during which passengers attend their offices), a lunchtime first-half operation, a lunchtime latter-half operation, and a closing hour operation (an operation for the period of time during which passengers leave their offices) are stored in the addresses TK11–TK41 of this table; the data of scheduled times for terminating the selection of the respective operation patterns are stored in the addresses TK12–TK42; and the data of whether the learning has been completed or uncompleted are stored in the addresses TK13–TK43.

As to the office-going hour operation pattern, the figure shows an example in which the data of the selection initiating time of "8 o'clock 10 minutes", the selection terminating time of "8 o'clock 55 minutes" and the "completion"of the learning are stored.

FIG. 4 is a diagram showing an example of the table of the revisional values of the learning results.

The data of the revisional values of the initiating times of the respective operation patterns in FIG. 3 are stored in the addresses TB11–41 of this table; the data of the revisional values of the terminating times of the respective operation patterns are stored in the addresses TB12–42; and the data of the revisional values of the degrees (intensities) of selection at the learning of the selection times of the respective operation patterns are stored in the addresses TB13–43. This table is stored in the floppy disc device 27 while the personal computer 25 is at a stop.

+ (plus) data and − (minus) data are respectively added for putting the time back and forward.

In addition, + (plus) data and − (minus) data are respectively added when the degree of selection is raised for easier selection) and when it is lowered (for more difficult selection).

The degree of selection can be set in a range of +10−−10. +10 is the most intense setting, 0 is the standard, and −10 is the weakest.

As to the office-going hour operation pattern, the figure shows an example in which the data of the initiation time revising value of "putting forward by 20 minutes", the termination time revising value of "putting back by 10 minutes", and the selection degree revising value of "−3"are stored.

FIG. 5 is a diagram showing an example of an operation pattern appellation table.

This table stores the display pattern data of operation pattern appellations in order to simplify a program which indicates the operation pattern names on the screen of the display device 12.

The figure shows an example in which the display character pattern data of the "office-going hour operation"in Roman characters stored in address NAME 1, that of the "lunchtime first-half operation" in address NAME 2, that of the "lunchtime latter-half operation" in address NAME 3, and that of the "closing hour operation" in address NAME 4.

Marks "Δ" signifies blanks (i.e., nothing is displayed) (the same applies hereinbelow).

Figure 6:
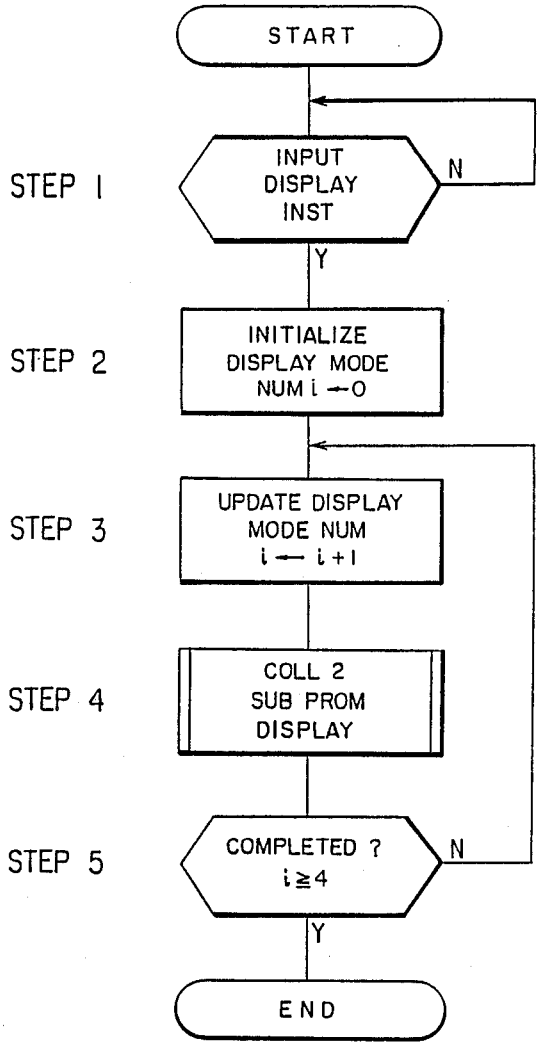
FIG. 6 is a flow chart showing an example of a learning function revision program which the personal computer in FIG. 2 runs.

FIG. 6 is a general flow chart showing an example of a learning function revision program which the personal computer 25 runs.

In the figure, STEP 1: this program is stored in the floppy disc device 27, and by inputting a file name (display instruction) by the keyboard 9, it is loaded in the memory 262 and has the run started.

STEPs 2–4: After the display mode No. (scanning No.) i corresponding to each operation pattern is initialized, it is incremented (+1) to set the operation pattern of i=1 (the office-going hour operation), whereupon a subprogram (revision processing program) DISP is called to execute revision processing.

STEP 5: Whether or not the processing has been completed is decided. Unless it has not been completed, the control flow is returned to STEP 3, and STEPs 3 and 4 are executed again. After i=4 has been established, that is, the revisional processes of all the operation patterns (i=2: lunchtime first-half operation, i=3: lunchtime latter-half operation, i=4: closing hour operation) have been executed, the processing of this program is ended.

i=1, . . . or 4 applies also to the description of programs to be mentioned later.

Figure 7:
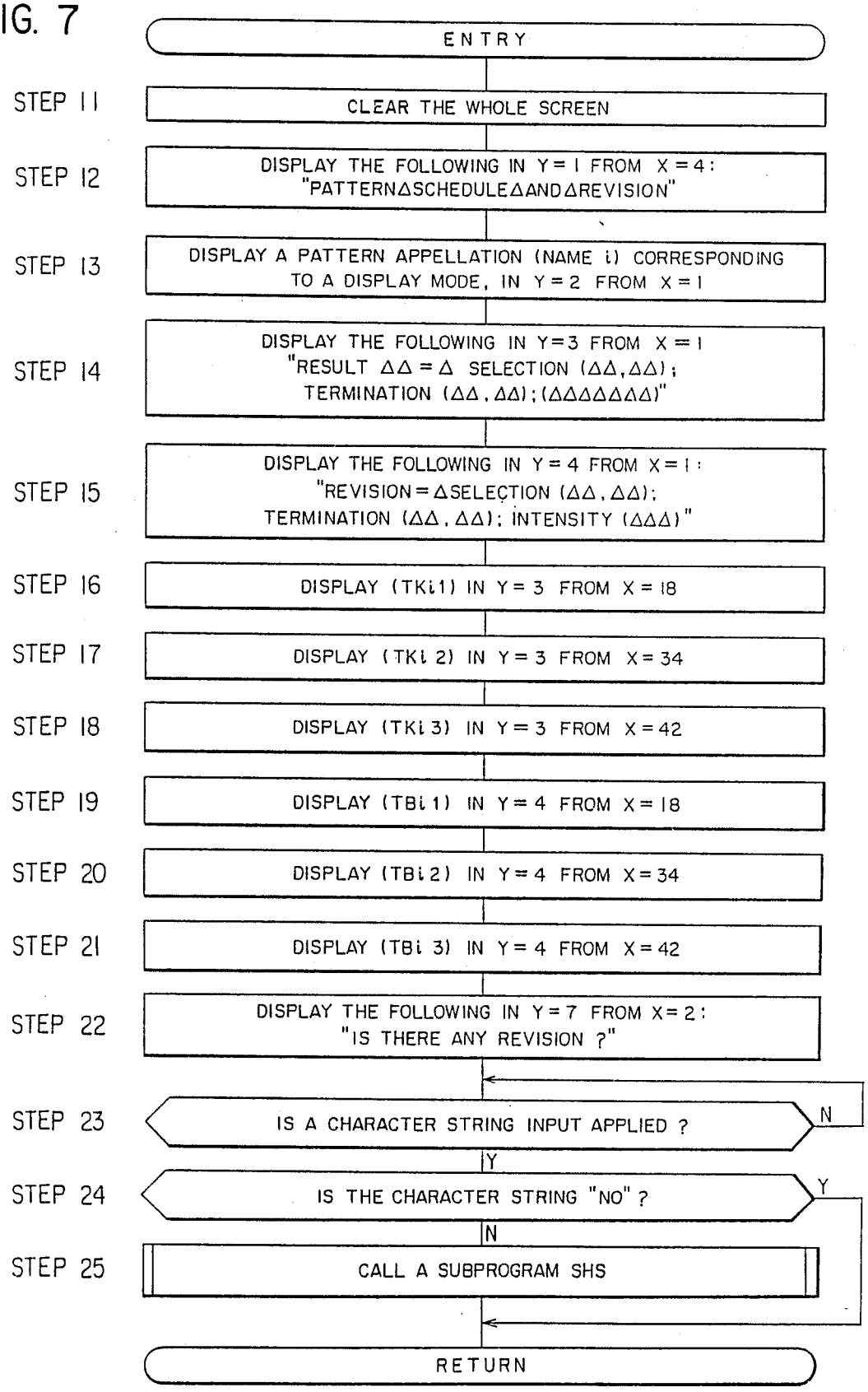
FIG. 7 is a flow chart showing an example of a subprogram in FIG. 6.

FIG. 7 is a flow chart showing an example of the subprogram (revision processing program) DISP at STEP 4 in FIG. 6.

In the figure (FIG. 8 being also referred to), STEP 11: the whole screen of the display device 12 is cleared.

STEP 12: In the axis of ordinates (row) Y=1 on the display screen of the display device 12, title "Pattern Schedule and Revision" (the display is in Roman characters, which applies hereinbelow) signifying that the ensuing display concerns pattern selection is displayed from the axis of abscissas (column) X=4.

STEP 13: In the row Y=2 of the screen, a pattern appellation which corresponds to the address NAME i of the pattern appellation table in FIG. 5 is displayed from the column X=1.

STEP 14: In the row Y=3 of the screen, characters previously determined for displaying the learning result of the pattern selection, "Result ΔΔ=Selection (ΔΔ, ΔΔ); Termination (ΔΔ, ΔΔ); (ΔΔΔΔΔΔΔ)" are displayed from the column X=1.

STEP 15 In the row Y=4 of the screen, characters previously determined for displaying the revisional value of the learning function of the pattern selection, "Revision ΔΔ= Selection (ΔΔ, ΔΔ); Termination (ΔΔ, ΔΔ); Intensity (ΔΔΔ)"are displayed from the column X=1.

STEPs 16–18: In the row Y=3 of the screen, the learning result data of the addresses $TK_{i1}$–$TK_{i3}$ of the learning result table in FIG. 3 are displayed from the column X blanked (Δ) at STEP 9.

STEPs 19–21: In the row Y=4 of the screen, the revisional value data of the addresses $TB_{i1}$–$TB_{i3}$ of the revisional value table in FIG. 4 are displayed from the column X blanked (Δ) at STEP 10.

STEP 22: In the row Y=7 of the screen, "Is there any revision?" for asking the necessity of the new revision of the learning function of the pattern selection corresponding to i is displayed from the column X=2.

STEPs 23–25: A character string is applied as an input. If the input character string is data (NO) signifying no revision (hereinbelow, termed "data (NO)"), the control flow returns directly to STEP 5 in FIG. 6. If the input character string is not the data (NO), a subprogram (revisional value input program) SHS is called, whereupon the control flow returns to STEP 5 in FIG. 6.

A display example of the office-going hour operation pattern in the case where this program has been run, is shown in FIG. 8.

This display example in FIG. 8 will be briefly explained. The title "Pattern Schedule and Revision" is displayed in the row Y=1 of the screen (STEP 12); "Office-going hour operation" indicative of the operation pattern is indicated in the row Y=2 (STEP 13); "Result=Selection (08, 10); Termination (08, 55); Completed" signifying the initiation time of 8 o'clock 10 minutes, the termination time of 8 o'clock 55 minutes, and the completion of the learning is displayed in the row Y=3 (STEPs 14, 17–18); "Revision=Selection (−0, 20); Termination (+0, 10); Intensity (−3)" signifying that the initiation time being the result of the past revision is advanced by 20 minutes, that the termination time is delayed by 10 minutes and that the intensity of the selection is −3, is displayed in the row Y=4 (STEPs 15, 19–21); and "Is there any revision?" for asking whether or not the revision is made, is displayed in the row Y=7 (STEP 22).

Figure 9:
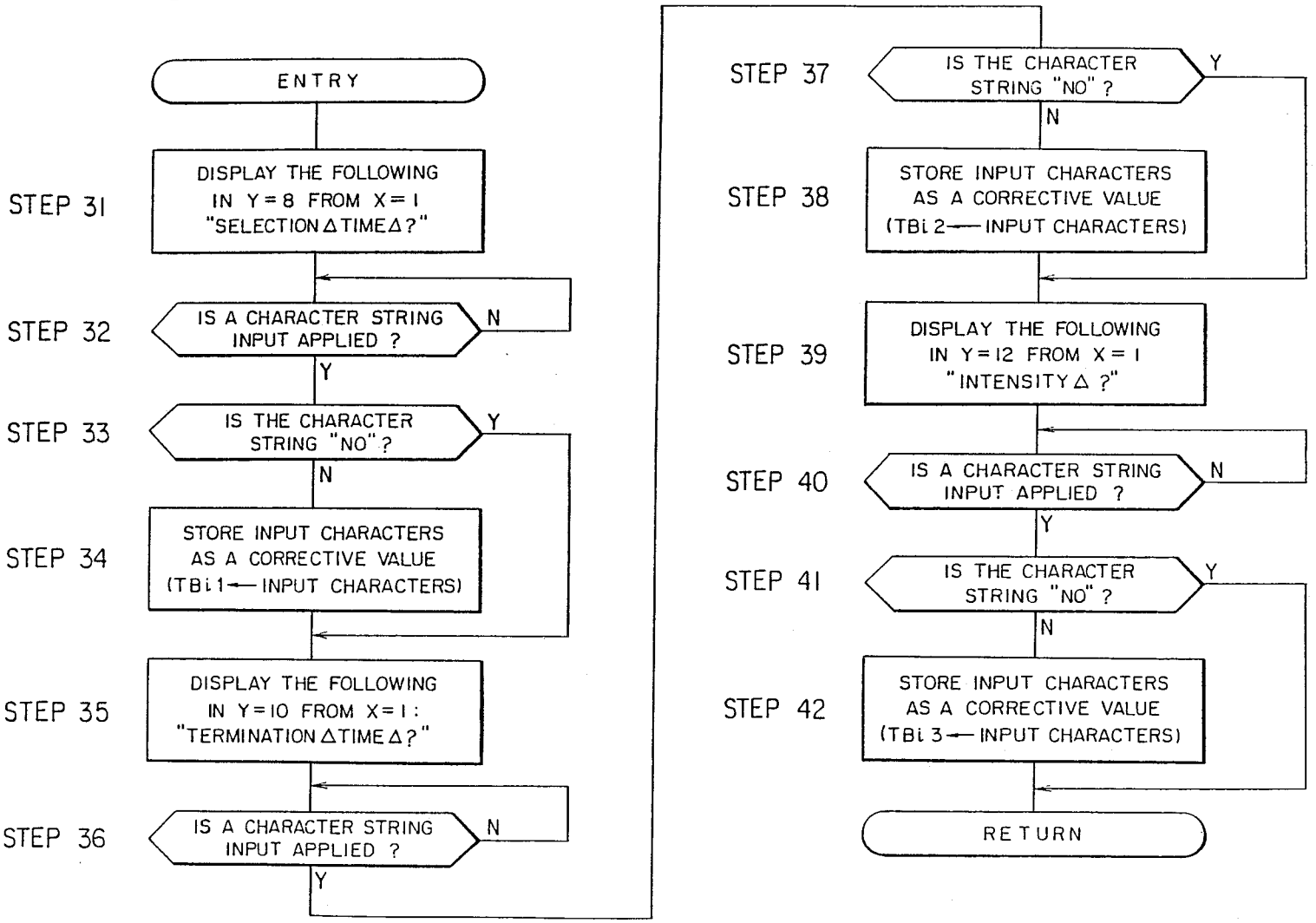
FIG. 9 is a flow chart showing an example of the subprogram in FIG. 7.

FIG. 9 is a flow chart showing an example of the subprogram (corrective value input program) SHS of STEP 25 in FIG. 7.

In the figure, STEPs 31–34: In the row Y=8 of the screen, "Selection time?" is displayed from the column X=1. If the input data is not the data NO, it is stored as a corrective value in the address $TB_{i1}$ of the corrective value table shown in FIG. 3.

STEPs 35–38: In the row Y=10 of the screen, "Termination time?" is displayed from the column X=1. If the input data is not the data NO, it is stored as a revisional value in the address $TB_{i2}$ of the revisional value table.

STEPs 39–42: In the row Y=12 of the screen, "Intensity" is displayed from X=1. If the input data is not the data NO, it is stored as a revisional value in the address $TB_{i3}$ of the revisional value table.

When, in this manner, the initiation time, termination time and intensity have been revised, the revisional values are displayed for updating in the parts of the screen corresponding to the revision results.

Figure 10:
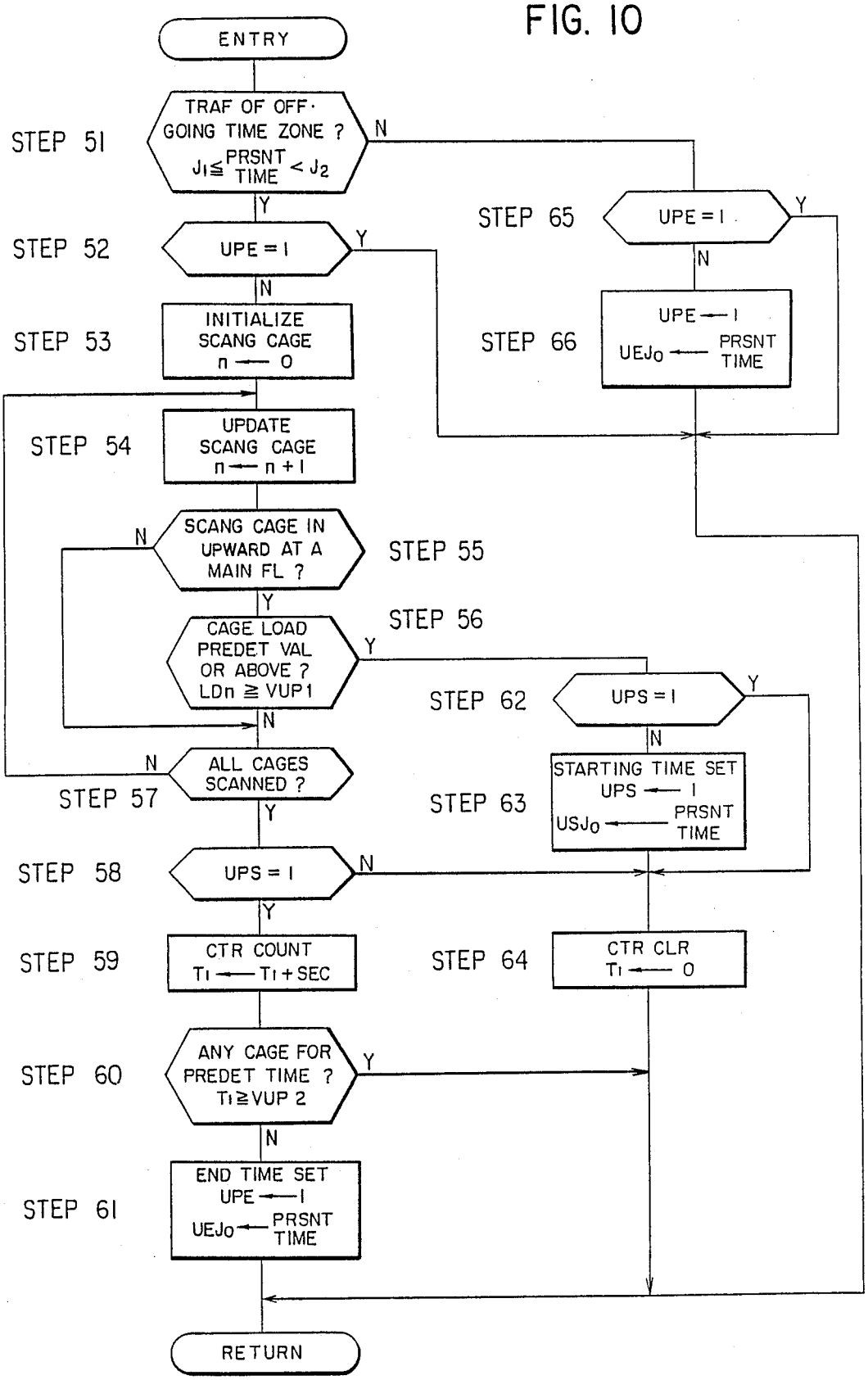
FIG. 10 is a flow chart showing an example of a pattern traffic detecting program which a statistics device in FIG. 2 runs.

FIG. 10 is a flow chart showing an example of a program for detecting the traffic of the office-going hour operation pattern, which is run by the statistics device 24 in FIG. 24. This program is run every fixed cycle, for example, every 0.1 sec.

First, the significances of abbreviations used in the figure are as follows:

n; Scanning cage memory.

$J_1$; Initiation time of an office-going time zone (fixed).

$J_2$; Termination time of the office-going time zone (fixed). $J_1$ and $J_2$ are set to define a time zone which is wider than the office-going time zone scheduled to be set and revised.

UPS; Initiation time already-set signal (already set at "1").

UPE; Termination time already-set signal (already set at "1").

$USJ_o$; Initiation time of the office-going hour operation of today.

$UEJ_o$; Termination time of the office-going hour operation of today. $LD_n$; Load in the cage of Elevator No. n.

VUP1; Cage load value (%) for detecting the office-going hour operation.

VUPT; Timer value (sec) for detecting the office-going hour operation.

$T_1$; Counting memory.

SEC; Elapsed time (sec) since a preceding calculation.

In FIG. 10, STEPs 51–53: whether or not the traffic is of the office-going time zone is checked. If it is not of the office-going time zone, the control flow proceeds to STEP 65. If it is of the office-going time zone, whether or not UPE=1 holds is checked. If UPE=1 holds, the control flow returns to the main routine, and if not, the scanning cage is initialized, and the control flow proceeds to STEP 54.

STEPs 54–57: All the cages, are checked as to whether or not they satisfy the condition of ascent at a main floor and the condition of a cage load not smaller than a predetermined value. The control flow proceeds to STEP 62 if any cage satisfies the conditions, and to STEP 58 if no cage satisfies the conditions.

STEPs 58–61: Whether or not UPS=1 holds is discriminated. Unless UPS=1 holds, the control flow proceeds to STEP 64. If UPS=1 holds, SES (for example, 0.1 sec) is added to a counter, whereupon it is discriminated if there is any cage satisfying the aforementioned conditions for a predetermined time. If no cage satisfies the conditions, the termination of the office-going hour operation is decided, and the termination time is set, whereupon the control flow returns to the main routine. If any cage satisfies the conditions, the control flow returns directly to the main routine.

STEPs 62–64: Whether or not UPS=1 holds is checked. If UPS=1 does not hold, a counter is cleared after setting the initiation time, and if it holds, the counter is directly cleared. Thereafter, the control flow returns to the main routine.

STEPs 65, 66: Whether or not UPE=1 holds is checked. If UPE=1 holds, the control flow returns directly to the main routine. If UPE=1 does not hold, it is established, and the termination time is set, whereupon the control flow returns to the main routine.

These steps will be concretely explained herebelow:

Assuming first that it is the office-going time zone now and that any cage satisfies the aforementioned conditions, STEPs 51–56 are executed and are followed by STEP 62. Since UPS=0 holds yet, UPS=1 is established, and the initiation time is set. Thereafter, STEP 64 is executed, and the control flow returns to the main routine.

Assuming that any cage satisfies the conditions also at the next time, STEPs 51–56 are executed and are followed by STEP 62. Since UPS=1 holds at this time, the control flow jumps to STEP 64 and returns to the main routine after the execution thereof.

Assuming that any cage no longer satisfies the conditions, STEPs 51–57 have been executed and are followed by STEP 58. Since UPS=1 holds at this time, the control flow proceeds to STEP 59, to start the measurement of the time. Unless the predetermined period of time has lapsed, the main routine is directly returned to. If it has lapsed, the main routine is returned to after establishing UPE=1 and setting the termination time.

Thenceforth, even in the office-going time zone, the main routine is returned to by the execution of STEP 52 without the processing.

Figure 11:
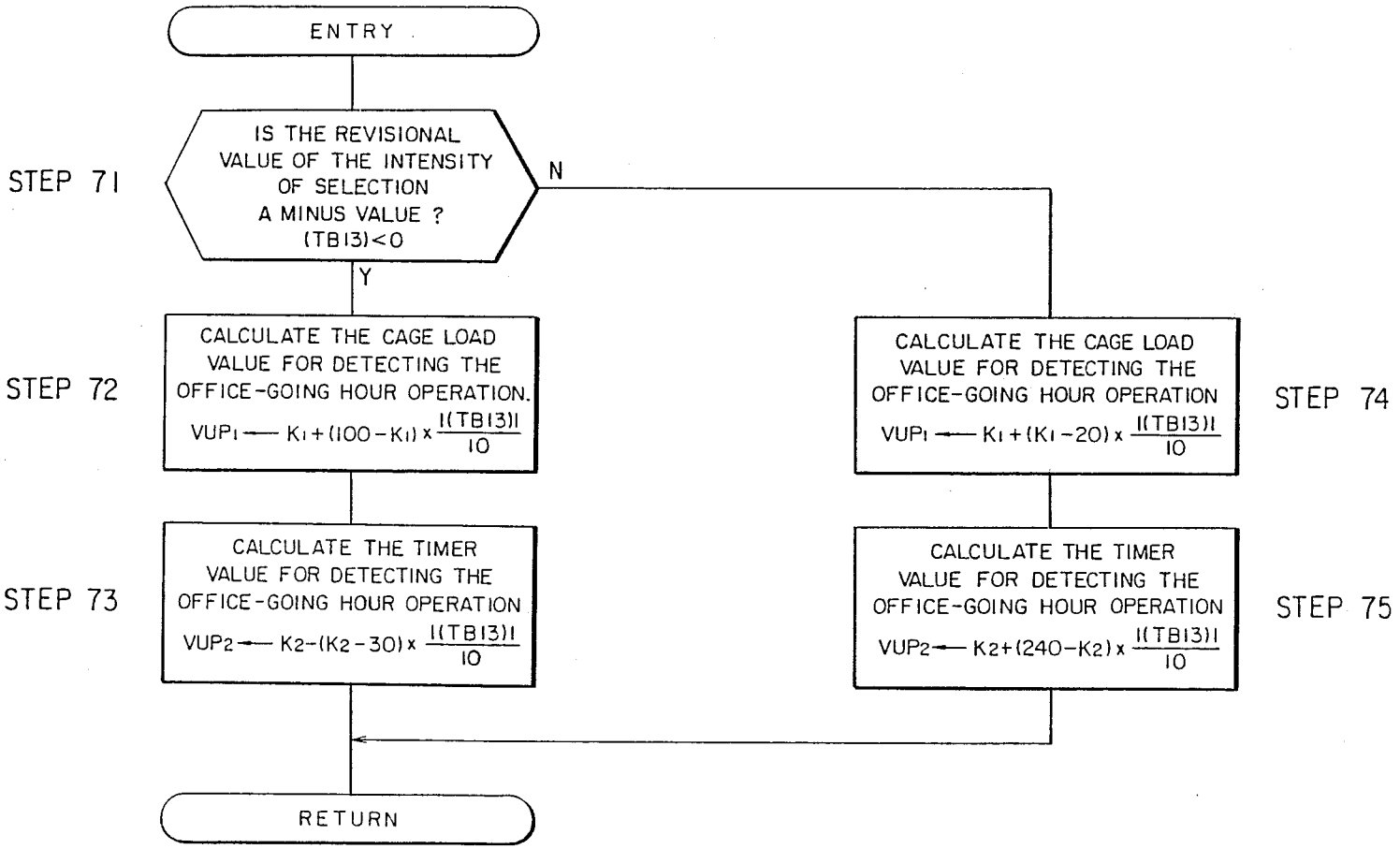
FIG. 11 is a flow chart showing an example of an intensity revision program to be run by the statistics device.

FIG. 11 is a flow chart showing an example of an intensity revision program which the statistics device 24 in FIG. 2 runs and in which the predetermined values VUP1 and VUP2 of STEPs 56 and 60 in FIG. 10 are altered to revise the intensity of pattern selection.

Referring to the figure, STEP 71: it is discriminated whether or not the revisional value of the intensity of selection which is stored in the address TB13 of the revisional value table in FIG. 4, received from the personal computer 25 in FIG. 2, is a minus value. If it is the minus value, the control flow proceeds to STEP 72, and if not, the control flow proceeds to STEP 74.

STEPs 72, 73: When the revisional value data of the address TB13 is the minus value, that is, when the revision is weak, the predetermined value VUP1 of the cage load is set at a high value and the predetermined value VUP2 of the time period at a short (small) value in correspondence with the absolute value of the revisional value.

STEPs 74, 75: When the revisonal value data of the address TB13 is not the minus value (it is a plus value), that is, when the revision is intense, the predetermined value VUP1 of the cage load is set at a low value and the predetermined value VUP2 of the time period at a long (large) value in correspondence with the absolute value of the revisional value.

K1 in the figure denotes a predetermined value (for example, 60%), and also K2 a predetermined value (for example, 120 sec).

Figure 12:
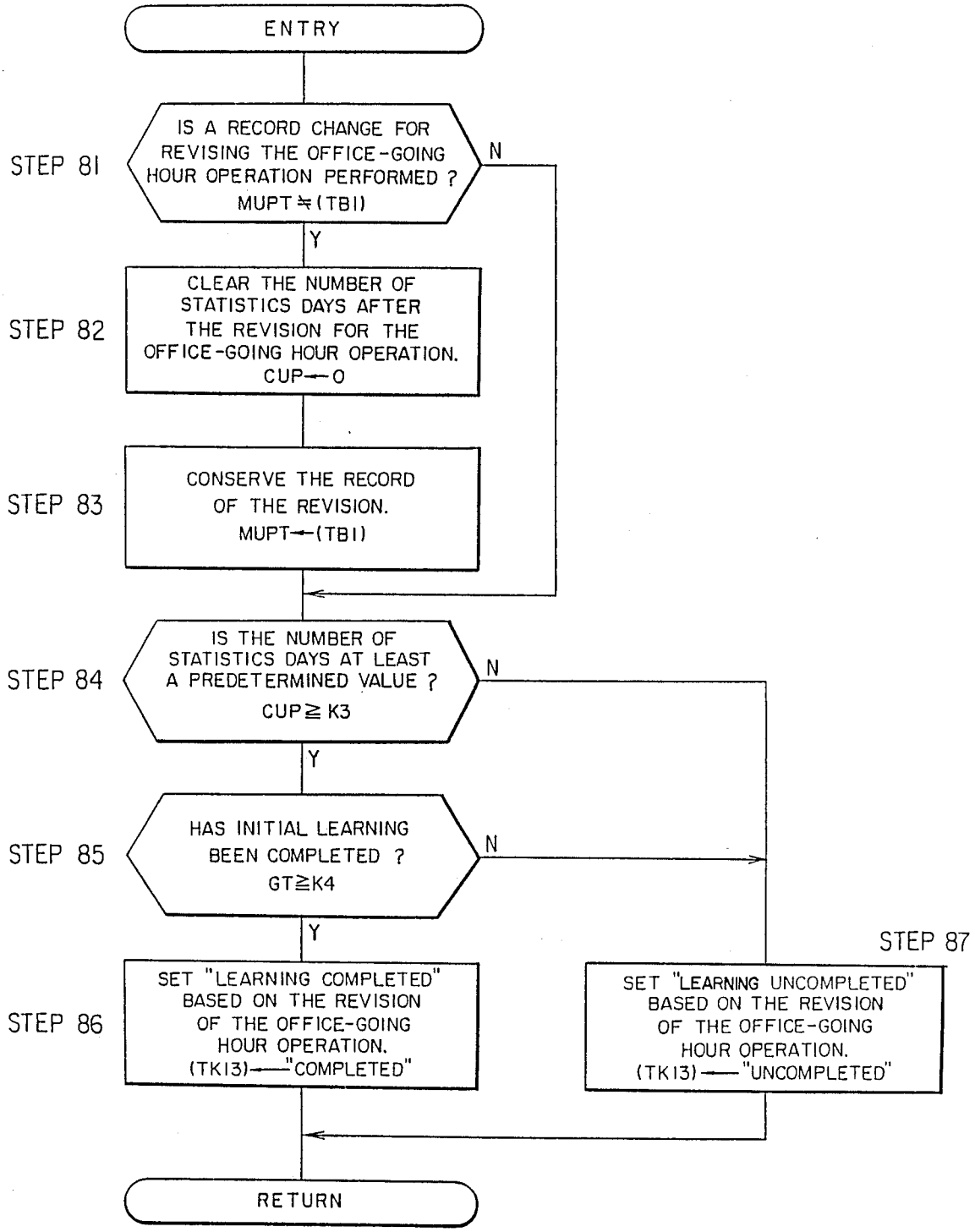
FIG. 12 is a flow chart showing an example of a learning completed/uncompleted judgement processing program to be run by the statistics device.

FIG. 12 is a flow chart showing an example of the learning "completed/uncompleted" (whether or not the learning result is usable) judgement processing program in the case of the office-going hour operation, the program being run by the statistics device 24 in FIG. 2.

First, the significances of abbreviations used in the figure are as follows:

MUPT: Conserved data of the record of the revision for the office-going hour operation.

CUP: Number of statistics days after the revision for the office-going hour operation.

$K_3$: Predetermined value (for example, 7 days).

GT: Number of days since the learning function has started operating.

$K_4$: Predetermined value (for example, 14 days).

Referring to the figure, STEPs 81–83: if a record change for revising the office-going hour operation is to be performed, is discriminated by checking whether or not the MUPT storing the contents of the address TB1 till the preceding time is identical to the content of the address TB1 at the current time. When they are not identical and the change is to be performed, the number of statistics days is set at "0", and the content of the address TB1 at the current time is stored in the MUPT, whereupon the control flow proceeds to STEP 84. When the change is not to be performed, STEP 81 is directly followed by STEP 84.

STEPs 84–86: It is discriminated whether or not the number of statistics days is at least a predetermined value and initial learning has been completed. When both are fulfilled, the data "completed" is stored into the address TK13 of the learning result table in FIG. 3. When at least either is not fulfilled, the data "uncompleted" is stored into the address TK13 of the learning result table.

Figure 13:
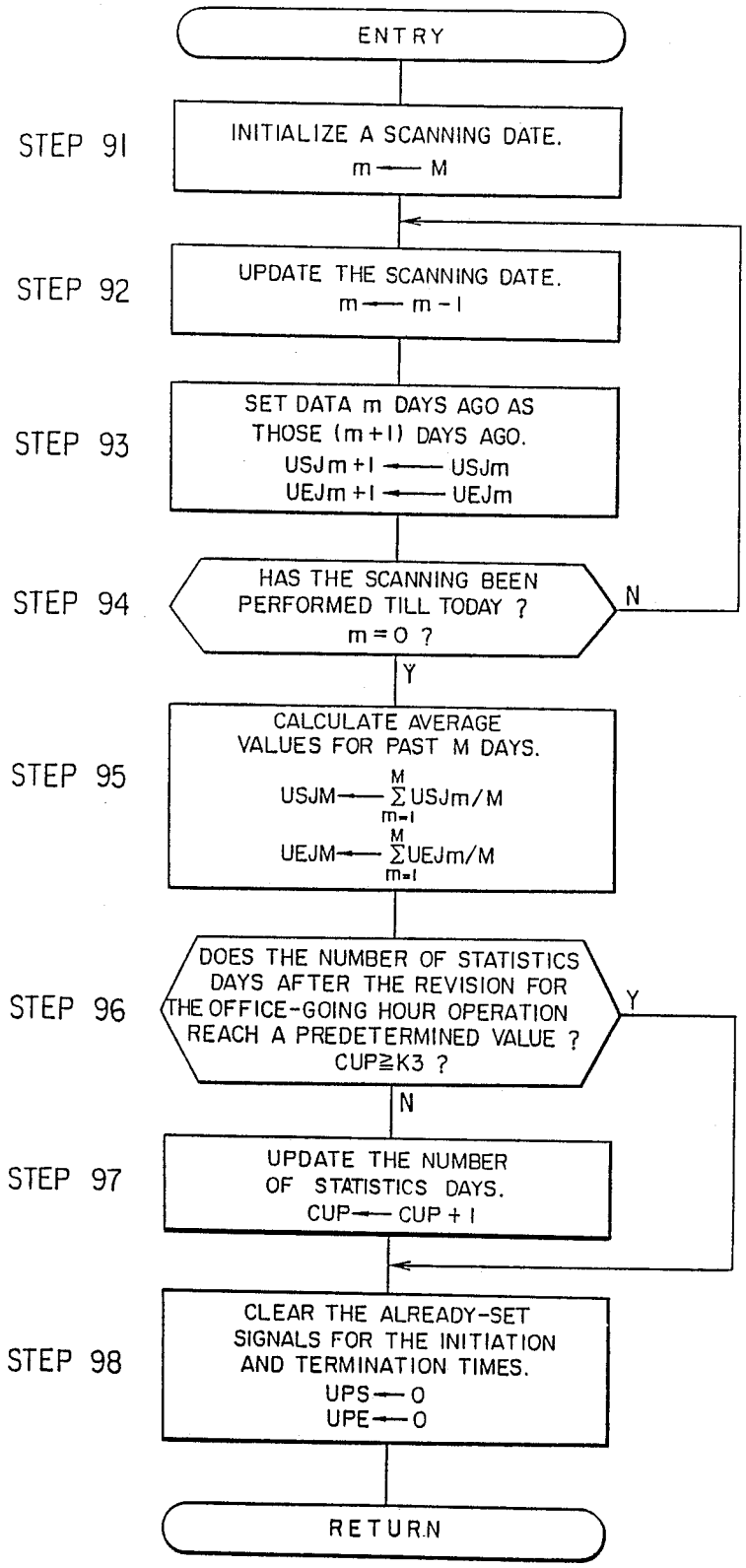
FIG. 13 is a flow chart showing an example of a statistic processing program to be run by the statistics device.

FIG. 13 is a flow chart showing an example of a statistic processing program for one day of the particular-day data in the case of the office-going hour operation, the program being run by the statistics device 2 in FIG. 2. This program is run once a day, for example, at 0 o'clock 0 minute.

First, the significances of the abbreviations used in the figure are as follows:

m; Memory for past scanning dates.

M; Indicating the presence of statistic data for past M days.

$USJ_m$; Initiation time of the office-going hour operation on the past m-th day.

$UEJ_m$; Termination time of the office-going hour operation on the past m-th day.

USJM; Average value of the initiation times of the office-going hour operations for past M days.

UEJM; Average value of the termination times of the office-going hour operations for the past M days.

Referring to FIG. 13, STEPs 91–94: after the initial scanning date is set at the past M-th day, 1 (one) is subtracted from m, and the initiation and termination times m days ago are set as data (m+1) days ago. These steps are repeatedly executed till m=0, at which the control flow proceeds to STEP 95.

By executing STEPs 91–94, the data of today becomes the data of 1 (one) day ago, the data of 1 (one) day ago becomes the data of 2 days ago, and thenceforth, the data (M−1) days ago becomes the data M days ago and the data of M days ago is erased.

STEPs 95–98: After the average values of the initiation times and termination times for the past M days are calculated, 1 (one) is added to the number of statistics days, and CPS and CPE (refer to FIG. 10) are cleared for the particular day. STEP 96 is a step which serves to prevent CUP from being subjected to the addition until it overflows.

Figure 14:
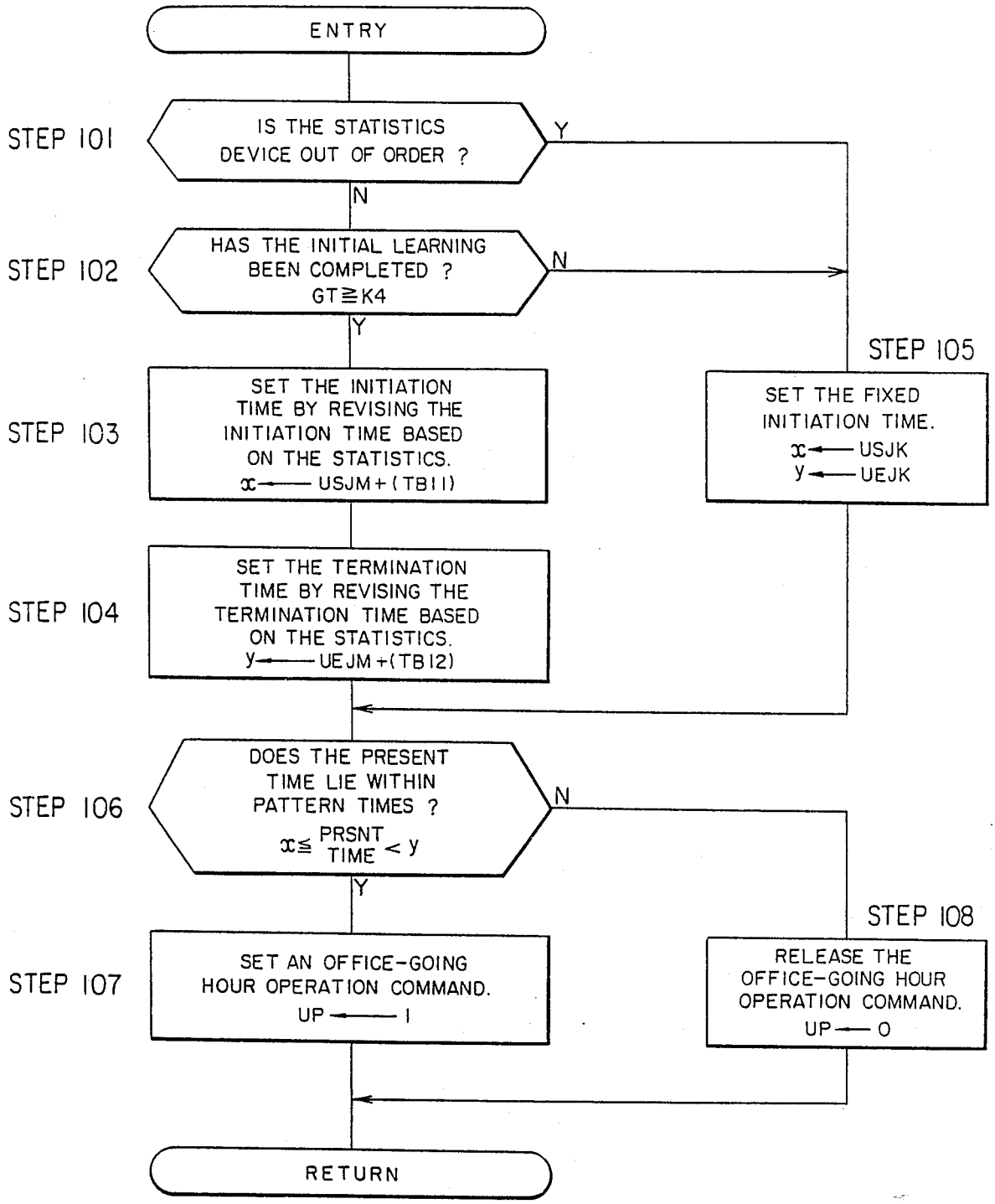
FIG. 14 is a flow chart showing an example of an office-going hour operation selecting program which a group supervisory device in FIG. 2 runs.

FIG. 14 is a flow chart showing an example of an office-going hour operation selecting program which the group supervisory device 23 in FIG. 2 runs.

First, abbreviations used in the figure are as follows:

x; Initiation time setting memory.

y; Termination time setting memory.

USJK; Fixed initiation time for the office-going hour operation.

UEJK; Fixed termination time for the office-going hour operation.

USJK and UEJK are stored in the ROM which constitutes the memory 232 in FIG. 2.

Referring to FIG. 14, STEPs 101, 102: It is discriminated whether or not the statistics device 24 is without trouble and the initial learning has been completed. When both are satisfied, the control flow proceeds to STEP 103, and when at least either is not satisfied, it proceeds to STEP 105.

STEPs 103, 104: The initiation time revision value data of the address TB11 of the revisional value table and the average initiation time data USJM, which are respectively received from the personal computer 25 and the statistics device 24 in FIG. 2, are added to set the initiation time. Likewise, the revisional value data of the termination time and the average termination time UEJM are added to set the termination time. The revisional value data are assigned the signs + and −.

STEP 105: The fixed initiation and termination times are used as the initiation and termination times.

STEPs 106–108: Whether or not the present time lies within the set initiation and termination times (pattern times), is discriminated. When it lies within the pattern times, an office-going hour operation command is set, and when it does not, the command is released.

Since, in this manner, the elevator supervision system of this embodiment can revise the result, method, intensity etc. of learning, it can realize a learning function as desired and can enhance the service.

In addition, by recording the revisional information or initializing the learning function at the start of the revision as in this embodiment, it is possible for the elevator supervision system to grasp the corresponding relation between the degree of the revision and the actual result, and a more appropriate revision is possible.

The embodiment has been stated, among learning functions, as to the example concerning the predictive control of the traffic pattern the selection time zone of which is somewhat determined and which is not frequently changed within a one day period. However, the invention is not restricted thereto but can be similarly performed on the other learning functions.

Regarding other numerous learning functions, for example, the selection of floors at which the cages are dispersedly to wait at, the alteration of the main floor, the setting of priority levels for correcting the inequity of the services of the respective floors, and the alteration of patterns in the allotment assessment of the cages; the learning functions can be similarly revised with a construction in which necessary information items are displayed as control variables for the learning method, the intensity and result of the learning, etc. and in which applied input revisional information can be recorded so as to permit revisions conforming to the revisional information.

As explained above, according to the present invention, the learning function of automatically changing the control of elevators so as to become suited to a building can be revised to a desired learning function by externally applying revisional information, so that the learning function can be rendered flexible, and the service can be enhanced. Moreover, conversation with a custodian or the like can be held.

What is claimed is:

1. A supervisory system for at least one elevator comprising:

statistical means for generating statistical data of traffic conditions of the elevator over a predetermined period according to at least one threshold value;

means for executing a learning function program for predicting traffic values on the basis of at least one adjustment value and the statistical data from the statistical means and for controlling the elevator in accordance with the predicted traffic value;

information input means for supplying revision information; and revision means for revising the threshold value and the adjustment value in accordance with the revision information supplied by the information input means, thereby revising the generation of statistical data and the prediction of traffic values.

2. The supervisory system of claim 1 wherein the learning function program executing means includes means for storing the revision information.

3. The supervisory system of claim 1 wherein the learning function program executing means includes means for initializing a learning function when revision information is supplied.

4. The supervisory system of claim 1 further including display means for displaying the predicted traffic values and the revision information.

5. A supervisory system for at least one elevator comprising:

means for collecting a plurality of elevator traffic values according to at least one threshold value;

means for generating an elevator control value including means for statistically processing the elevator traffic values to provide a statistical value and modifying the statistical value by an adjustment value to provide the elevator control value;

means for controlling the elevator in accordance with the elevator control value; and means for inputting revision information and for revising the threshold value and the adjustment value in accordance with the revision information.

6. A supervisory system for at least one elevator comprising:

an input device for inputting at least first and second revision values;

a memory device coupled to the input device for storing the first and second revision values;

means coupled to the memory device for providing a threshold value and an adjustment value according to the first and second revision values, respectively;

means for selecting elevator traffic data according to the threshold value;

means for statistically processing the traffic data to provide a statistical value;

means for generating an elevator control value according to the statistical value and the adjustment value;

means for selecting an elevator operation pattern in accordance with the control value.

7. The supervisory system of claim 6 further comprising an output device coupled to the memory device for displaying the first and second revision values.

8. The supervisory system of claim 7 wherein the memory device includes means for storing a set of first and second revision values for each of a plurality of predetermined time periods.

9. The supervisory system of claim 8 further comprising means for initializing the traffic data selecting means upon inputting the first and second revision values.

10. The supervisory system of claim 9 wherein the processing means includes means for generating a statistical value indicative of the mean value of the traffic data and wherein the elevator control value generating means includes mean for adding the statistical value and the adjustment value.

11. The supervisory system of claim 10 wherein the input device includes means for inputting a first revision value including an intensity value and wherein the threshold value and adjustment value providing means include means for calculating a first threshold value if the intensity value is above a predetermined value and a second threshold value if the intensity value is below the predetermined value.

* * * * *